United States Patent [19]

Howland et al.

[11] 4,145,846

[45] Mar. 27, 1979

[54] CONTOUR BELT GRINDING DEVICE

[75] Inventors: John S. Howland, Boston; George A. Wood, Jr., Lincoln, both of Mass.

[73] Assignee: The Cessna Aircraft Company, Wichita, Kans.

[21] Appl. No.: 808,972

[22] Filed: Jun. 22, 1977

[51] Int. Cl.[2] ..... B24B 21/06; B24B 21/16

[52] U.S. Cl. ..... 51/140; 51/141; 51/144

[58] Field of Search ..... 51/135 R, 135 BT, 140, 51/141, 143, 144, 145 R, 146, 148, 328; 29/156.8 P

[56] References Cited

U.S. PATENT DOCUMENTS

| | | | |
|---|---|---|---|
| 572,812 | 12/1896 | Longden | 51/140 |
| 736,939 | 8/1903 | Cole | 51/140 |
| 1,134,508 | 4/1915 | Blevney | 51/140 |
| 1,175,332 | 3/1916 | Aubrey | 51/140 |
| 2,426,764 | 9/1947 | Czarnecki | 51/141 X |
| 2,722,787 | 11/1955 | Hallewell | 51/142 |
| 3,552,067 | 1/1971 | Przygocki | 51/135 BT |

FOREIGN PATENT DOCUMENTS

| | | | |
|---|---|---|---|
| 482281 | 4/1973 | U.S.S.R. | 51/141 |

*Primary Examiner*—N. P. Godici

*Attorney, Agent, or Firm*—Biebel, French & Nauman

[57] ABSTRACT

A propeller grinding device and method employs two endless grinding belts which are transported past a grinding station to finish the front and back surfaces. A propeller blank is inserted between the belts and the belts are distorted by platens, each of which includes a plurality of independent platen vanes. Two cams selectively bear upon two camming surfaces of the vanes and move the vanes into desired positions corresponding to the surface contours to be formed on the front and back surfaces of the propeller blades. The cams are rotated as the blade is moved. They also may be moved along the camming surfaces. Additionally, the cams and platens may be moved parallel to the direction of cam rotation with respect to the belts.

12 Claims, 6 Drawing Figures

CONTOUR BELT GRINDING DEVICE

BACKGROUND OF THE INVENTION

The present invention relates to grinding devices and, more particularly, to a grinder having an endless grinding belt capable of grinding contours, such as the airfoil shape of a propeller.

Belt grinders have been used in the past for finishing a flat surface. U.S. Pat. No. 2,706,873, issued Apr. 26, 1955 to Gifford, shows a sanding device having an endless sanding belt, which belt is continuously rotated and urged into contact with the workpiece by a plurality of rollers. U.S. Pat. No. 3,129,535, issued Apr. 21, 1964, shows a similar grinding arrangement in which two grinding belts grind opposite sides of the workpiece simultaneously. This eliminates the need for backing arrangements opposite the belts to offset the grinding forces applied by the belt mechanisms.

U.S. Pat. No. 3,670,458, issued June 20, 1972, to Faure, shows a multiple-position grinding arrangement in which a plurality of workpieces are ground simultaneously. Cam mechanisms are used to present the workpieces in predetermined attitudes to the grinder and to alter the orientation of the grinding belts.

As shown in U.S. Pat. No. 2,723,505 issued Nov. 15, 1955 to Krafft, the flexibility of a grinding belt may be utilized advantageously to grind predetermined contours as well as flat surfaces of a workpiece. In the Krafft devices, a repetitive pattern is ground by using an appropriately contoured metal roller as the backup roller for a flexible abrasive belt. The contoured metal roller of the Krafft device is rotated at the same speed as the abrasive belt.

It has been recognized that a need exists for a machine capable of grinding relatively complex contours. One approach, shown in U.S. Pat. No. 3,049,839 issued Aug. 21, 1962 to Smith, and U.S. Pat. No. 3,859,757 issued Jan. 14, 1975 to Heesemann, is to provide a flexible plate as the platen for the abrasive belt at the grinding station. This flexible plate can be distorted in shape to the appropriate contour. Both the Smith and Heesemann machines use a plurality of air-actuated cylinders for distorting the flexible platens. The dimensions of such cylinders, however, necessitate the use of relatively few cylinders across the width of the abrasive belt, thereby limiting the complexity of the contour which may be ground.

U.S. Pat. No. 3,685,219 issued Aug. 22, 1972 to Palmenberg, discloses another approach to altering the contour of a driven abrasive belt. In the Palmenberg patent, a patent is provided having a plurality of air holes. Pressurized air is forced through these holes and generates an air cushion against which the abrasive belt is urged. The Palmenberg device is said to be particularly useful in grinding the airfoil shapes of a turbine vane.

U.S. Pat. No. 2,426,764 issued Sept. 2, 1947 to Czarnecki, shows a machine useful in finishing propeller blades. An abrasive belt is moved past a cam which defines the desired airfoil shape at the grinding station. The cam is rotated in synchronism with the movement of the propeller blade past the grinding station such that the contour being ground is changed continuously. The cam acts directly upon the back of the abrasive belt, with an intermediate rubber cusioning belt provided in between.

None of the belt grinders disclosed above provide an arrangement for grinding a range of airfoil shapes without substitution of machine parts. While Czarnecki does permit a continuous abrasive belt grinding operation for a propeller blade, the contour roller acts directly upon the abrasive belt so that only a single propeller blade size can be machined with a given roller. Additionally, the roller tends to wear, even when an intermediate belt is positioned between the back of the abrasive belt and the roller.

SUMMARY OF THE INVENTION

A contour grinding device has a grinding belt which is movable past a grinding station and a platen adjacent the belt for distorting the belt into a desired contour. The platen includes a plurality of independently movable platen vanes which define a first camming surface. A cam means including a first cam bears upon the first camming surface for moving the vanes into desired positions. Means are provided for moving the cam means with respect to the vanes such that the relative positions of the vanes may be altered. A wear-preventing belt, interposed between the platen vanes and the grinding belt, is moved periodically and minimizes the wear of the vanes by the grinding belt.

A second camming surface may be provided on the vanes, with a second cam in contact therewith. Means are provided for moving the second cam into contact with the second camming surface as the first cam is moved out of contact with the first camming surface, to provide an unbroken transition in contour on the workpiece. Both the first and second cams may be rotated as well as moved along their respective camming surfaces. The cams and the platen may also be moved with respect to the grinding belt in a direction which is parallel to the axis of cam rotation.

A dual belt grinding machine having first and second endless grinding belts may be provided in which the contour shapes of the belts are controlled by corresponding first and second belt platen means. Each platen means includes a plurality of vane members and dual cams which bear upon each of the vane members and which urge the belts into the desired contours.

Accordingly, objects of the present invention are to provide a contour grinding device and method in which an endless grinding belt grinds the desired shape for a workpiece, in which the contour to be ground is determined by a cam acting upon a plurality of vanes, which vanes in turn form a platen acting upon the belt; in which the cams may be rotated as the workpiece is moved and translated with respect to the vanes such that a plurality of contour surfaces may be specified; and in which dual endless grinding belts simultaneously act upon opposite sides of the workpiece.

It is also a particular object of the invention to provide a method and apparatus for the finishing of the contour of aluminum propeller blades from forged propeller blanks, to apply by, profile grinding, the inboard and outboard airfoil sections of the blade simultaneously along the front and back surfaces of the blade to provide for the smooth transition between the inboard and outboard sections, and to control accurately and automatically the amount of material removed from the blank so as to form a finished or substantially finished blank.

A further object of this invention is the provision of a controllable grinding apparatus provided with a pair of grinding belts together with a multiple element platen for controlling the contour of the belts at a grinding station for the purpose of forming in a blank or a workpiece contours simultaneously on upper and lower surfaces thereof, such as the forming of the airfoil shape on an aluminum propeller blade, as outlined above.

It is also an object of this invention to provide a method of removing metal from a blank, such as a propeller blade blank, involving the steps of moving belt grinding surfaces in opposed relation at opposite sides of a grinding station, moving a propeller blade blank between the grinding surfaces in contact therewith at the grinding station in a spanwise direction and simultaneously altering the contour of the belt surfaces at the grinding stations with the movement of the blank, so that the surfaces of the blank at the grinding station are finished. The method may provide the further steps of moving the blank in rotation during grinding or otherwise tilting or moving the blank to accommodate for the twist of the blade, the tilt of the blade, and/or the sweep of the blade.

These and other objects and advantages of the invention will be apparent from the following description, the accompanying drawings, and the appended claims.

DESCRIPTION OF THE PREFERRED EMBODIMENTS

Figure 1:
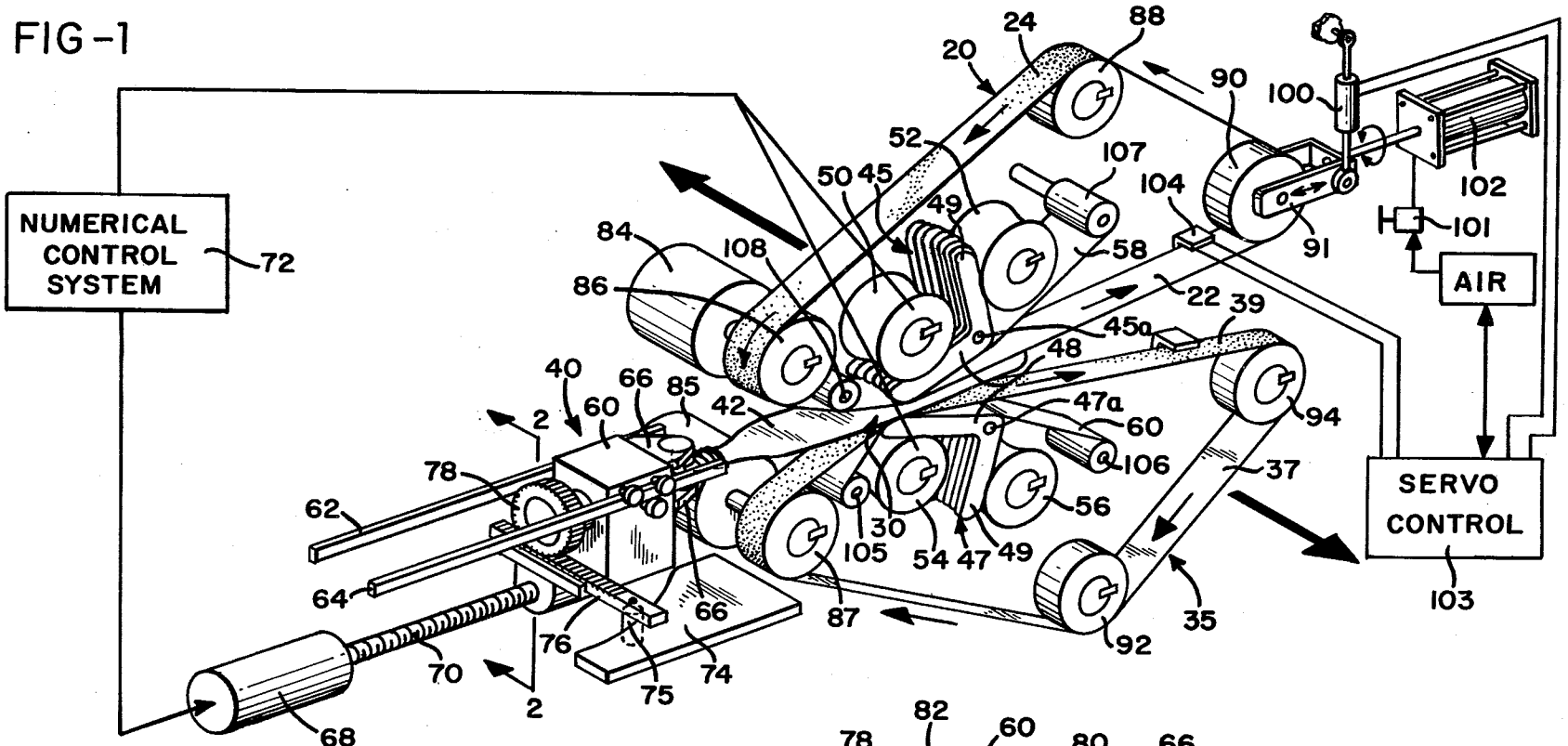
FIG. 1 is a diagrammatic perspective view illustrating the grinding device of the present invention.

Referring now to FIG. 1, there is shown the dual belt, contour grinding mechanism of the present invention. A first endless grinding belt 20 has an inner backing surface 22 and an outer grinding surface 24, and is mounted for continuous movement of the grinding surface 24 past a grinding station indicated generally at 30. A second endless grinding belt 35 has an inner backing surface 37 and an outer grinding surface 39, and is mounted for continuous movement past the grinding station 30 in the same direction as the first belt 20. Belt 20 will generally be rotating counterclockwise, as seen in FIG. 1, and belt 35 will be rotating in a clockwise direction. A chuck means indicated generally at 40 is provided for holding and positioning a workpiece 42, such as a forged aluminum propeller blank, so that portions of the workpiece 42 are placed between the first belt 20 and the second belt 35 at the grinding station 30. In the case of a propeller blade blank, the belts 20 and 35 will be applied to form the face and back blade surfaces of the propeller.

First and second belt platen means are positioned respectively adjacent the backing surface 22 and 37 of the first and second grinding belts 20 and 35, for urging the belts against the workpiece 42 in the desired contours. The belt platen means may comprise a plurality of, or a stack of, generally L-shaped individual vane members 45 and 47, cam means 50, 52, 54 and 56, and means for moving the cam means with respect to the vane members to alter the contour of the belts 20 and 35.

The individual L-shaped vane members are thus formed with an inner leg 48 and a generally right angled outer leg 49, arranged such that the outer platen surfaces of the inner legs bear against their respective belts. The vane members 45 and 47 are stacked closely together in side-by-side relation on a common shaft or support 45*a* and 47*a*. The cam means 50 and 54 are positioned immediately adjacent the upper surfaces of the respective forward legs 48, while the cam means 52 and 56 are positioned immediately adjacent the outer surface of the corresponding outer legs 49. The cam means have formed thereon a transverse contour which varies circumferentially thereabout so that the vane members translate to the belts the precise contours of the cams, and rotation as well as translational movement of the cams may be effected for the purpose of changing or varying the contours transmitted by the vane members to their respective belts.

As noted, each of the vane members 45 and 47 bears upon the backing surface of the associated grinding belt at the grinding station, and each of the vane members is independently, pivotally movable on its support with respect to the other vane members.

The flexible wear-preventing belts 58 and 60, such as fabric-backed graphite belts, may be interposed between the platen vane members 45 and 47 and the grinding belts 20 and 35. The wear-preventing belts 58 and 60 are moved only periodically and prevent wear on the vane platen surfaces which would otherwise result if such lower surfaces were in continuous or direct contact with the backs of the moving grinding belts.

Figure 2:
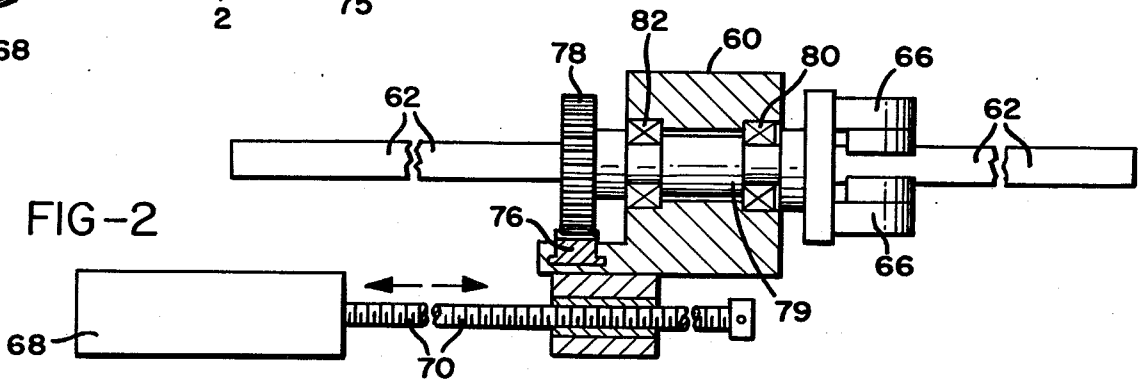
FIG. 2 is a sectional view of the workpiece chuck mechanism of the present invention taken generally along the line 2—2 in FIG. 1.

The workpiece chuck means 40 holds and supports the workpiece 42 as the workpiece is moved between the belts at the grinding station 30. Additionally, means are provided for orienting the workpiece 42 and the chuck means 40 as the workpiece 42 is moved past the grinding station 30. An outer carriage 60 is movable along fixed support rails 62 and 64 and provides for a rotating mounting for blade clamps 66, as shown in greater detail in FIG. 2. Lateral movement of chuck means 40 is controlled by motor 68 which rotates drive screw 70 under control of conventional numerical control 72. A rotation cam 74 cooperates with a cam follower 75 on a geared rack 76 and a pinion gear 78 to effectuate rotation of workpiece 42. The gear 78 is connected by a shaft 79 directly to the blade clamps 66 as shown in FIG. 2. The shaft 79 is mounted in the outer carriage 60 on bearings 80 and 82. The working surface of the cam 74 causes the workpiece, in the case of a propeller blade, to follower the twist of the blade as the blade blank is ground.

Motors 84 and 85 are provided to drive continuously pulleys 86 and 87 and belts 20 and 35, respectively. Idler pulleys 88, 90, 92 and 94 are provided to control movement of the belts.

Each idler pulley 90 and 94 is provided with a tension control arrangement, and for the sake of clarity only the tension arrangement associated with the pulley 90 is shown. The idler pulley 90 is thus supported by yoke 91 which has attached thereto pneumatic cylinders 100 and 102. The cylinder 102 provides tensioning of belt 20 by pulling on yoke 91. The tension is controlled by the level of air pressure in cylinder 102 which, in turn, is controlled by air regulator 101. The cylinder 100 is arranged to rotate the yoke 91 and pulley 90 slightly in response to indications from an air gauge 104 that the belt 20 is not centered on the pulley 90. The cylinder 100 is controlled by servo control 103. Rollers 105, 106, 107 and 108 are driven periodically by motors (not shown) as the wear preventing belts 58 and 60 are worn by the movement of grinding belts 20 and 35 therepast.

The wear preventing belts 58 and 60 are diagrammatically shown in FIG. 1 as running between rollers 105 and 106 for the belt 60 and rollers 107 and 108 for the belt 58, as a means for supporting and applying the wear belts through the grinding station 30 as previously described. A more complete arrangement for supporting and moving the wear belt is described in connection with FIG. 3 below.

In FIGS. 3–6 there is illustrated a commercial embodiment of the invention. In these figures, parts which correspond either directly or substantially to parts illustrated in FIG. 1 are retained and referred to with the same reference numerals. However, where the parts are somewhat changed from that illustrated in FIG. 1, new reference numerals are applied in the interest of clarity.

Figure 3:
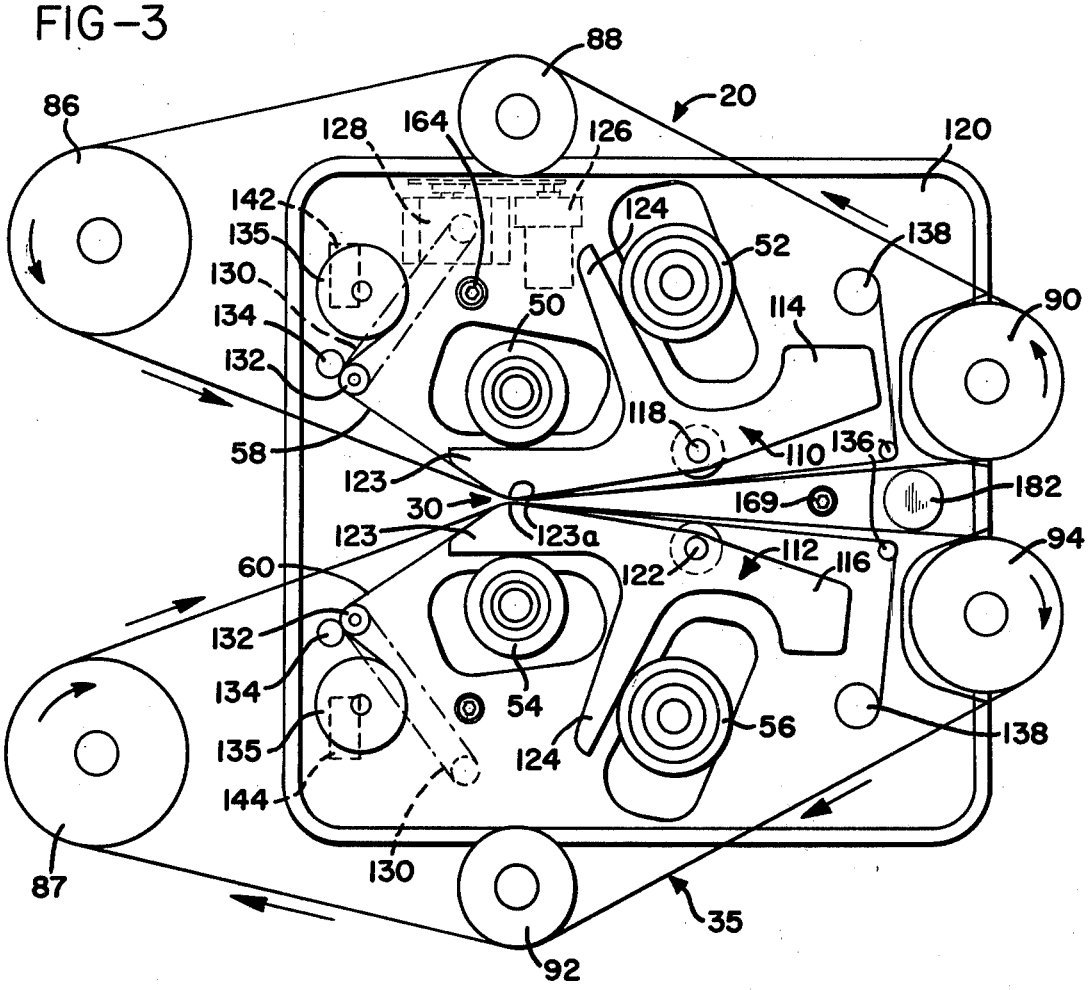
FIG. 3 is a front view showing mounting structure for the cams and platens and illustrating a variation in platen design.

Referring first to FIG. 3, stacked platen vanes illustrated generally at 110 and 112 are provided, which correspond in function to the vanes 45 and 47 shown in FIG. 1. A plurality of the platen vanes are employed stacked in side-by-side relation. The platen vanes 110 and 112 are respectively mounted for pivotal movement on pivot shafts 118 and 122. These shafts in turn are supported on a main support plate or frame 120.

As in the case of the vanes described in connection with FIG. 1, the vanes 110 and 112 each include a forwardly extending portion 123 which has an upper camming surface for coaction with the cam 50 and a lower surface for coaction with the belt 20, and each vane has an outwardly extending portion 124 which has a rearward camming surface for coaction with the cam 52. The vanes 110 and 112 are formed with rearwardly-extending counter-balance portions 114 and 116. Except for the counter-balance portions 114 and 116, the vanes are generally L-shaped when viewed in elevation, and are similar in function and design to the vanes 45 and 47.

Figure 4:
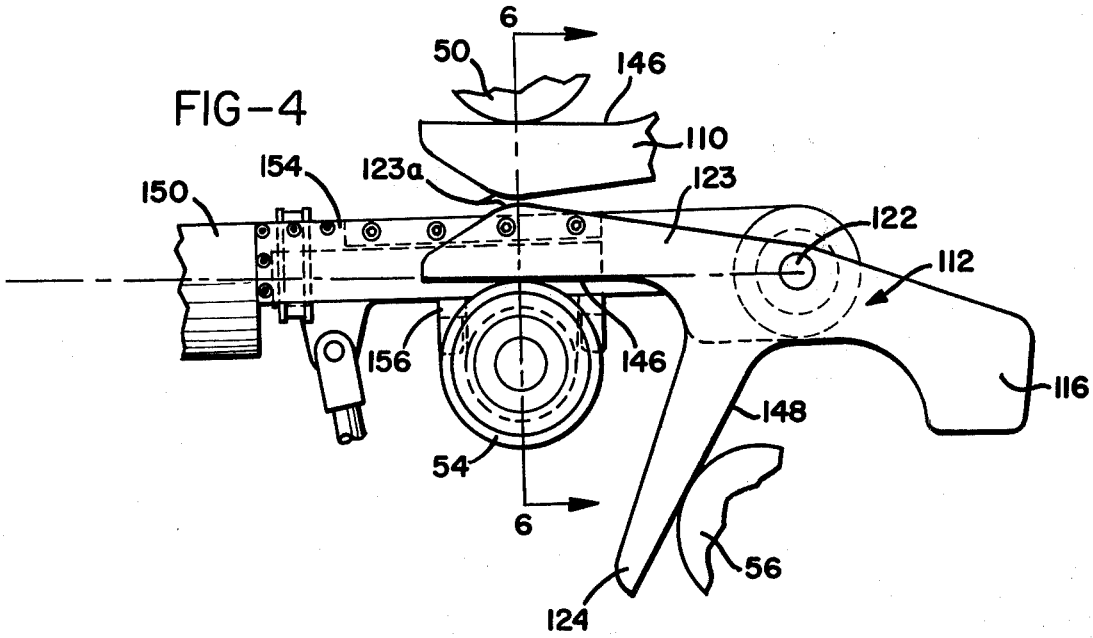
FIG. 4 is an enlarged partial view similar to FIG. 3 with portions of the structure broken away and removed.

The forward portions 123 of the vanes are provided with arcuately curved working surfaces **123*a* as shown in FIG. 4. These working surfaces are arranged in opposed relationship between the stacks of vanes and define therebetween the gap comprising the grinding station 30. The curved portions 123*a* bear in direct force transmitting and contouring relation to the respective belts 20 and 37, with the wear belts 58 and 60** being interposed therebetween.

As shown in FIG. 3, the wear belts are provided with identical take-up and transport rollers and drive means. For this purpose, a belt drive motor 126 shown in phantom near the upper portion of the plate 120 and mounted on the back thereof drives a gear reduction 128. The gear reduction drives a belt 130 which drives a pinch roller 132. The belt is received between the pinch roller 132 and an idler roller 134. Reference numeral 135 represents a spooled supply of the wear belt material which is fed through the rollers 132 and 134, under the working surface **123*a* of the platen vanes and rearwardly over an idler 136 onto an internal driven take-up reel 138. The wear belts 58 and 60** assure minimum wear by preventing direct contact between the belts and the vanes while transmitting the position of the vanes to the grinding belts.

FIG. 4 shows an enlarged fragmentary view of the platen vane and cam arrangement, with the support plate 120 not shown in the interest of clarity. The cam 54 is positioned to cooperate with a first planar camming surface 146 formed on the forwardly extending portion 123 of the vane 112. The surface 146 lies in a line which, when extended, intersects or extends through the axis defined by the pivot 122. Similary, the cam 56, only a fragment of which is shown, cooperates and engages a second camming surface 148 which is formed on a right-angled portion 124 of the vane 112. The surface 148, when projected, also intersects the axis of the pivot 122. Thus, the surfaces 146 and 148 lie along radius lines with respect to this pivot point.

As previously noted, the cams 54 and 56 are mounted for translational movement along lines generally parallel to their respective camming surfaces, and radially with respect to the pivot 122. In the case of the cam 54 (as well as the cam 50), a motor 150, which may be under the control of the numerical control 72, is mounted on the extended end of a motor and cam mounting bar or arm 154. The arm 154 is similarly pivotally supported on the pivot 122. As shown in the transverse section in FIG. 6, the arm 154 is formed with a U-shaped guide way or track indicated generally at 155, and a cam shaft support 156 is slidably mounted in the guideway 155. The motor drives a lead screw 157 which is threaded in a nut 158 mounted on the support 156. The cam itself is shown in FIG. 6 as being mounted on a shaft 160 extending through a spindle 162 and the spindle is, in turn, mounted or otherwise suitably secured to the support 156, to the end that rotation of the screw 157 causes the support 156 to move along the guideway or track 155, thereby displacing the spindle 162 and the supported cam 54 in translation in a direction generally parallel to the camming surface 146 and in a direction which is radial with respect to the common pivot 122.

Figure 6:
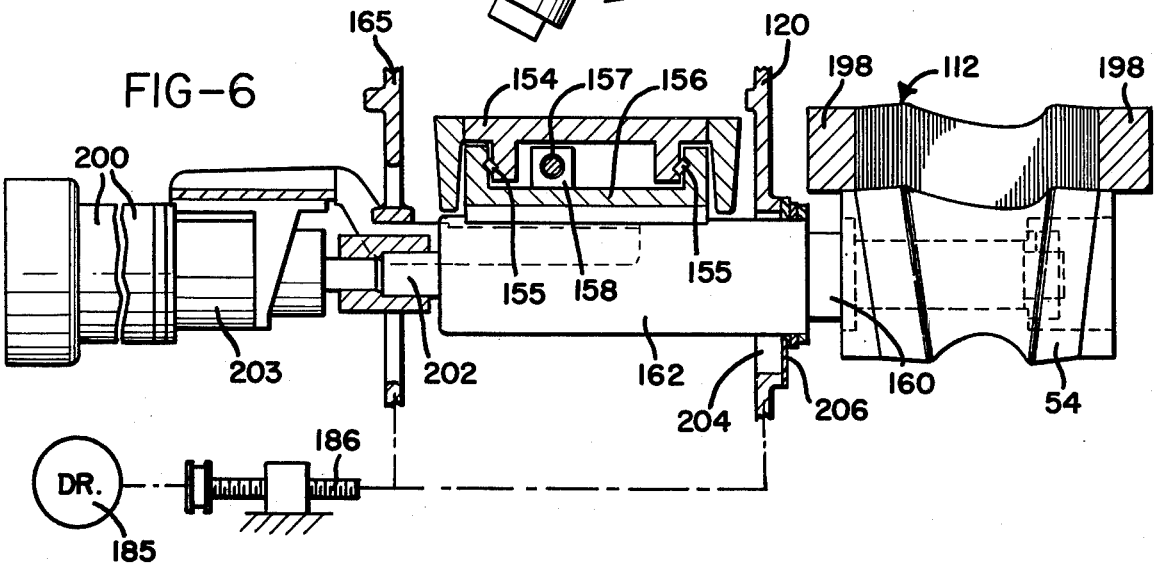
FIG. 6 is a sectional view taken generally along the line 6—6 of FIG. 4.

While the translational adjustment for the cam 54 has been described in detail in reference to FIGS. 4 and 6, it is understood that identical mechanisms are provided for the remaining cams which permit the same to be moved in translation radially of their pivot points 118 and 122. This has the advantage of permitting a single set of cams 50, 52, 54, 56 to be used to grind a family of parts having the same, or essentially the same, contour. For example, a family of propellers having the same airfoil cross section may thus be made even through the blades differ in length, chord and thickness. Such a family of propeller blades can be made using a cam to develop, for example, a Clark-Y or RAF-6 profile, as is well known to those skilled in the art.

Figure 5:
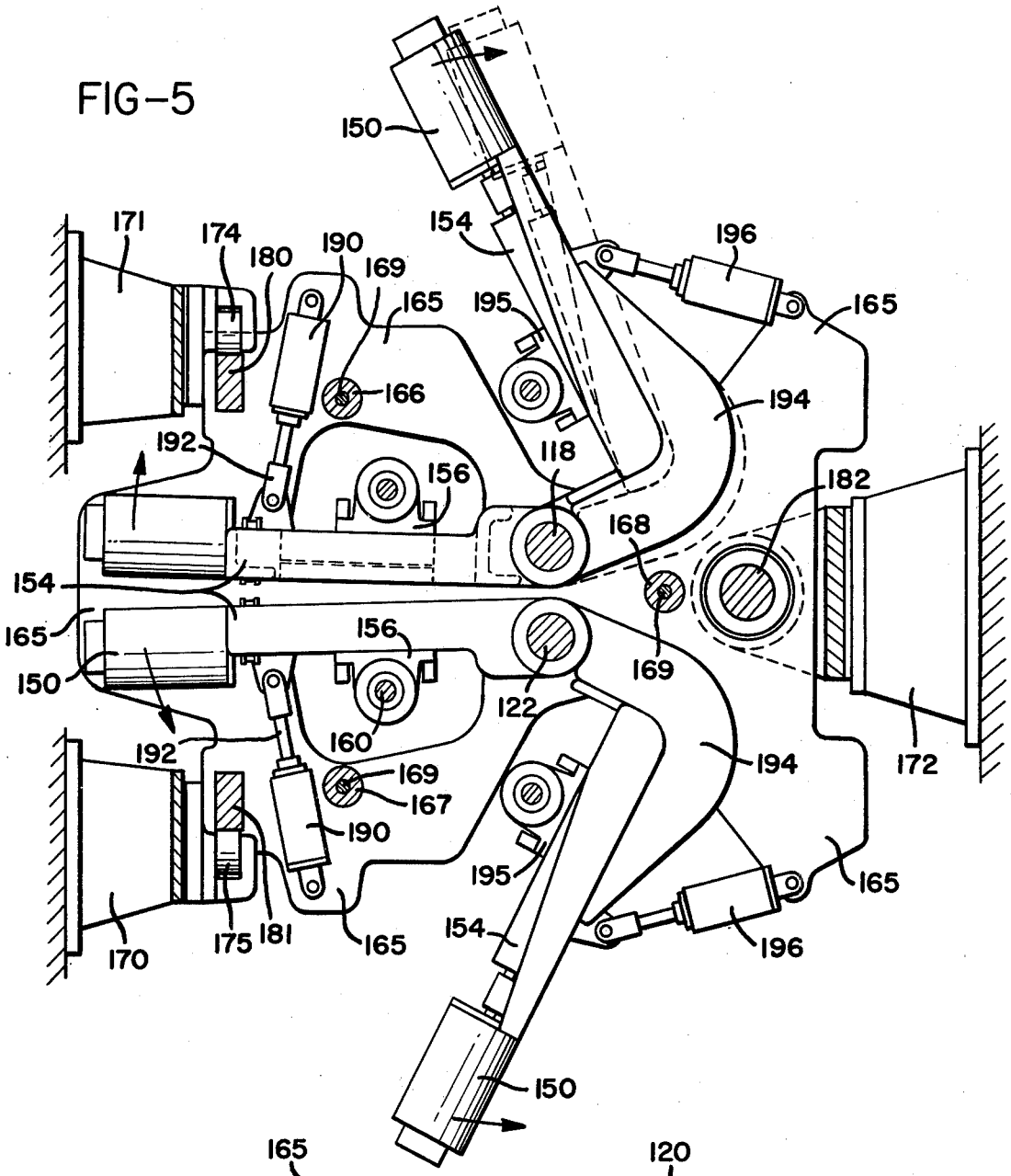
FIG. 5 is a view similar to FIG. 3 with a mounting plate removed.

Referring to FIG. 5, the main supporting structure for the plate 120 is shown with the plate removed, and with the cam shafts and connection stubs being shown in cross section for the purpose of identifying their location. In reference to FIG. 5, a main frame 165 is shown as supporting spaced bosses 166, 167 and 168 arranged in triangular relation. These bosses are tubular spacers and set off the plate 120 from the frame 165 and thus are supported on the plate 120 in spaced relation to the frame 165. The plate and frame are joined by threaded fasteners 169. The assembly of parts supported on the plate 120 and frame 165 is in turn supported on the machine frame for limited transverse movement, so that the assembly of cams can be moved along their rotational axes and transversely to the direction of movement of the belts 20 and 35. In this manner the position of the profile, as defined by the cams, may be shifted transversely to the direction of belt movement to accommodate for sweep of the propeller blade or such other transverse curvature or offset of the workpiece being ground. For the purpose of providing this transverse movement, the main frame 165 is supported on a basic machine frame, as defined by the fixed mounts 170, 171 and 172. The mounts 170 and 171 are shown as supporting rollers 174 and 175 which respectively engage transversely oriented support tracks 180 and 181. The tracks 180 and 181 extend between the plate 120 and the frame 165. The mount 172 supports a rod 182 and the frame 165 and is slidably mounted on this rod, thus providing three-point support providing for transverse movement of the main frame 165. Means for moving the main frame together with the connected plate 120 is diagrammatically illustrated at FIG. 6 as including a drive 185 and a lead screw 186. It is understood that the drive 185 may be placed on the control of the numerical control 72.

As previously mentioned, the invention includes means for moving each of the cams selectively into and out of engagement with the respective working surfaces 146 and 148 on the platen vanes 110 and 112. In this manner, a continuously changing profile may be applied to the workpiece which profile extends beyond the range of any one cam. Thus, one of the pair of cams 50, 52 may be employed to apply a first portion of the profile, and the other may then be employed to apply a second portion of the profile. For example, cam 50 (and associated cam 54) may be used to apply the outboard airfoil section to the propeller blade while cams 52 and 56 may then be employed to apply the thicker root section of the propeller blade. Thus, each of the cams 50, 54 are mounted to the pivot on arms or mounting bars 154 and the selective movement of the cams 50 and 54 into and out of engagement with the platen vanes is effected by the use of air cylinders 190 as shown in FIG. 5. The piston rods of the air cylinders 190 are connected to the bars 154 by clevis and pin arrangements 192. The retracting movement effected by the air cylinders 190 is as indicated by the arrows.

The cams 52 and 56 are mounted on modified L-shaped mounting arm bars 194 as shown in FIG. 5. These mounting bars are similarly pivotally attached to the pivots 118 and 122 and the cam mounts 195 on the arms 194 are identical to the corresponding mounts 156 on the arms 154, and their movement is controlled by the air cylinders 196.

Reference is again made to FIG. 6, which is a sectional view taken generally along the line 6—6 in FIG. 4. The independently movable platen vanes comprising platen means 112 are held together firmly by plates 198, in the same shape as the vanes, and which ride upon the outer edges of the cam 54, but which do not come into contact with the workpiece. The rotation of the cam 54 may be effected by motor 200 under the control of numerical control 72. Motor 200 and cam 54 are connected by shaft 202 which is geared down by reduction gear means 203. A seal 206 prevents grinding dust and cooling oil from passing through the access opening 204 in the plate 120.

It can be seen that the provision for rotation of the cams, as well as for translation of the cams along the camming surfaces, and for movement of the platen means and the cams with respect to the belts, permit a high degree of flexibility in the operation of the belt grinding device. Additionally, the use of two cams on separate camming surfaces of vanes, which vanes are positioned between the cams and the grinding belt, will permit the cams to be used for an entire family of propeller configurations of varying size.

The apparatus and method of this invention are thus particularly useful in the grinding of propeller blades from aluminum forgings, commonly known as propeller blanks. The selective use of a pair of cams 50 and 52, operating upon the respective legs of the vane members 110, and the corresponding use of the pair of cams 54 and 56 cooperating with corresponding legs of the vane members 112, provide convenient selection in grinding air foil contours at outboard and inboard sections of the propeller blade. Thus, for example, one set of cams 52 and 56 may be employed for the purpose of simultaneously finishing the outboard airfoil section of a propeller blade to a desired cross-sectional contour, where changes in contour along the blade axis or span are relatively gradual, but nevertheless, must be precisely controlled in relation to the blank.

On the other hand, the inboard or root section of the propeller blade requires substantially greater deflections and curvature of the grinding belts 20 and 35, and for this purpose, for example, the cams 50 and 54 may be provided with a substantially greater contour necessary to accomplish the profile grinding of this axial section of the propeller blade.

The cam 74 is designed to introduce to the workpiece 42 the precise twist of the propeller blank as it moves through the grinding stage 30. Since propeller blades are often designed with sweep characteristics, as known to those skilled in the art, the ability to move the cams and platens in a direction parallel to the axes of rotation of the cams permits accommodation of sweep without the necessity for moving the workpiece or propeller blank in a corresponding direction while it is being moved axially and rotated by the chuck means 40.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention.

What is claimed is:

1. A contour grinding device comprising a grinding belt movable past a grinding station, platen means positioned adjacent said belt at said grinding station for distorting said belt into a desired contour, said platen means including a plurality of independently movable platen vanes having thereon first and second camming surfaces, a first cam having a first contour thereon for bearing upon said first camming surface for moving said vanes into desired positions, a second cam having a contour thereon different from that of said first cam for bearing upon said second camming surface, and means for moving said first and second cams selectively into contact with said respective first and second camming surfaces.

2. The contour grinding device of claim 1 further including means for moving said first and second cams in translation along said first and second camming surfaces, respectively, and means for rotating said first and second cams.

3. The contour grinding device of claim 2 further comprising workpiece chuck means for holding a workpiece and moving the workpiece past said grinding station such that a continuous surface is ground at said grinding station, and means for orienting said workpiece and said chuck means as said workpiece is moved past said grinding station.

4. A dual belt, contour grinding machine, comprising a first endless grinding belt having an inner backing surface and an outer grinding surface, means mounting said first belt for continuous movement of said grinding surface past a grinding station, a second endless grinding belt having an inner backing surface and an outer grinding surface, means mounting said second belt for continuous movement past the grinding station in the same direction as said first belt, means for holding and positioning a workpiece such that portions of said workpiece are placed between said first and second belts at the grinding station, first and second belt platen means, positioned adjacent said backing surfaces of said first and second grinding belts, respectively, for urging said belts against the workpiece in the desired contours, each of said belt platen means including a plurality of individual pivotally mounted vane members, each of said vane members bearing upon the backing surface of an associated said grinding belt at the grinding station and each of said vane members being independently movable about its pivot point with respect to the other vane members, separate cam means for each of said platen means, each of said cam means bearing upon the associated said vane members and urging said vane members into contact with the belt such that said belt is distorted into a desired contour, and means for moving each of said cam means along its associated said vane members with respect to the pivot points of said vane members to alter the position of the belt at said grinding station.

5. A grinding machine for applying an airfoil surface to a forged aluminum aircraft propeller blank, comprising:

a pair of endless grinding belts, means for mounting said grinding belts for movement in opposed relation thereby defining a grinding station therebetween, chuck means for supporting said blank for relatively spanwise movement between said belts at said station, platen means for deforming at least one of said belts concurrently with said spanwise movement to apply a desired airfoil contour to said blank, said platen means having a plurality of individual vanes positioned in side-by-side relation, means mounting said vanes for pivotal movement, said vanes bearing on said one belt for deforming said one belt at said station, a cam having at least a portion of the desired finished blade contour thereon positioned to engage said vanes thereby to impart to said one belt the contour of said cam, means for moving said cam in translation generally radially of the pivot point of said vanes to permit the grinding of a family of propeller blades haing generally the same airfoil contour, and means at said chuck means for rotating said blank concurrently with said spanwise movement in accordance with the twist of the propeller blank.

6. The machine of claim 5 further comprising means for rotating said cam concurrently with said spanwise movement of said blank to affect a change in belt contour in accordance with said spanwise movement.

7. The machine of claim 5 further comprising a second cam selectively engageable with said vanes, and means on said second cam forming a continuation of the airfoil contour of said propeller blade.

8. A dual belt, contour grinding machine, comprising a first endless grinding belt having an inner backing surface and an outer grinding surface mounted for continuous movement of said grinding surface past a grinding station, a second endless grinding belt having an inner backing surface and an outer grinding surface mounted for continuous movement past the grinding station in the same direction as said first belt, means for holding and positioning a workpiece such that portions of said workpiece are placed between said first and second belts at the grinding station, and first and second belt platen means positioned adjacent said backing surfaces of said first and second grinding belts, respectively, for urging said belts against the workpiece in the desired contours, each of said belt platen means including a stack of vanes arranged in side-by-side relation, each of said vanes bearing upon the backing surface of an associated grinding belt at the grinding station, and each of said vanes being independently movable with respect to the other vanes, a cam bearing upon said vanes and urging said vanes into contact with the belt such that said belt is distorted into the desired contour, means for rotating said cam with respect to said vanes to alter the contour of the belt, and means for moving said cam in translation with respect to said vanes.

9. A grinding machine for forming the airfoil surface on a forged aluminum propeller blade blank comprising:

chuck means for supporting a propeller blade blank, an endless grinding belt movable past a grinding station in a direction generally parallel with the span of the finished blade, means for moving said blank relative to said belt in a generally spanwise direction, platen means at said grinding station for transversely deforming said belt in accordance with a desired airfoil contour including first cam means having the outboard portion of the blade airfoil contour formed thereon and selectively effective to impart said contour to the corresponding portion of said blank, and second cam means having the inboard portion of the finished blade contour formed thereon and selectively effective to impart such inboard contour to the inboard section of the blank.

10. The grinding machine of claim 9 in which said platen means includes a plurality of transversely oriented fingers engageable with said belt at said station and having a first surface in a plane extending through the pivot point of said fingers engageable with said first cam means and having a second surface also lying in a plane intersecting the pivot point thereof and engageable with said second cam means.

11. The grinding machine of claim 10 in which said first cam means is movable along said first surface toward and away from said pivot point to vary the relative position of said fingers at said gring station.

12. The grinding machine of claim 11 in which each of said cam means is movable along its respective said surface toward and away from said pivot point to vary the relative position of said fingers at said grinding station.

* * * * *

UNITED STATES PATENT AND TRADEMARK OFFICE

CERTIFICATE OF CORRECTION

PATENT NO. : 4,145,846

DATED : March 27, 1979

INVENTOR(S) : John S. Howland, George A. Wood, Jr.

It is certified that error appears in the above-identified patent and that said Letters Patent are hereby corrected as shown below:

Column 1, line 53, "patent" should be -- platen -- at second occurrence in line;

Column 4, line 55, "follower" should be -- follow --.

Column 6, line 8, "similary" should be -- similarly --.

Claim 5, line 58, "haing" should be -- having --.

Claim 11, line 60, "gring" should be -- grinding --.

Claim 12, line 61, "claim 11" should be -- claim 10 --.

Signed and Sealed this

*Eighteenth* Day of *September 1979*

[SEAL]

*Attest:*

*Attesting Officer*

LUTRELLE F. PARKER

*Acting Commissioner of Patents and Trademarks*